United States Patent [19]

Sherman et al.

[11] Patent Number: 4,808,017

[45] Date of Patent: Feb. 28, 1989

[54] PIVOTABLE CHARACTER DISPLAY FOR A TYPEWRITER

[75] Inventors: Howard F. Sherman, McGraw; James H. Greggains, Truxton; Hans W. Mueller, Cortland; Robert L. Kasprzycki, Pompey, all of N.Y.

[73] Assignee: Smith Corona Corporation, Cortland, N.Y.

[21] Appl. No.: 100,149

[22] Filed: Sep. 23, 1987

[51] Int. Cl.[4] ..... B41J 3/46

[52] U.S. Cl. ..... 400/83; 400/680; 340/711

[58] Field of Search ..... 400/83, 84, 680, 691; 340/700, 711, 720; 248/292.1, 1 B; D14/106; D18/2

[56] References Cited

U.S. PATENT DOCUMENTS

| | | | |
|---|---|---|---|
| D. 287,969 | 1/1987 | Kusanagi | D14/106 |
| D. 288,566 | 3/1987 | Chin et al. | D14/106 |
| D. 291,442 | 8/1987 | Kurihara | D14/106 |
| 4,568,080 | 2/1986 | Yokoi | 340/700 X |
| 4,620,808 | 11/1986 | Kurtin et al. | 400/83 |
| 4,624,434 | 11/1986 | Lake, Jr. et al. | 248/292.1 X |
| 4,739,316 | 4/1988 | Yamaguchi et al. | 340/711 |

FOREIGN PATENT DOCUMENTS

| | | | |
|---|---|---|---|
| 2177348 | 1/1987 | United Kingdom | 400/680 |

OTHER PUBLICATIONS

IBM Technical Disclosure Bulletin, vol. 28, No. 6, Nov. 1985, pp. 2476–2477, "Six-Point Hinge Mechanism".

*Primary Examiner*—Paul T. Sewell
*Assistant Examiner*—James Lisehora
*Attorney, Agent, or Firm*—Kenneth W. Greb

[57] ABSTRACT

A character display is pivotably mounted on an electronic typewriter for pivotable movement from an open position for viewing the character display to a closed position for covering the keyboard. The character display has a pivot axis in alignment with a rotatable axis of the platen. A structure for pivotably mounting the character display includes a spring operable to dampen the pivotable movement of the character display near the closed position. A brake pad combined with the dampening spring holds the character display in manually selected positions near the open position. A paper support which covers a platen and an adjacent open area is combined with the character display located in the closed position to provide a cover for the typewriter.

6 Claims, 5 Drawing Sheets

PIVOTABLE CHARACTER DISPLAY FOR A TYPEWRITER

BACKGROUND OF THE INVENTION

1. Field of the Invention

This invention relates to a character display having a relatively flat liquid crystal display "LCD" panel for an electronic typewriter and, more particularly, it relates to an improved means for mounting the LCD panel including means for mounting the LCD display so that it does not affect other typewriter requirements such as ease of paper insertion and removal. In the closed position, the LCD panel and paper support provide a typewriter cover which conforms to an aesthetically integrated typewriter design.

2. Prior Art

A character display pivotably mounted on a typewriter is disclosed in U.S. Pat. No. 4,620,808 issued on Nov. 4, 1986 and invented by Kurtin et al. Disadvantages of this disclosed pivotable character display are that it does not permit an aesthetically integrated design with the typewriter; it does not permit a low profile typewriter; and it increases the width of the typewriter.

A character display pivotably mounted on a portable computer is disclosed in a U.S. Pat. No. Des. 288,566 issued on Mar. 3, 1987 and invented by Arthur W. Chin et al. Since this computer does not have a built-in printer, it is not concerned with mounting the LCD panel in such a manner that it does not affect other typewriter requirements.

SUMMARY OF THE INVENTION

A character display having a cover member and a relatively flat LCD panel forming a relatively flat structure is pivotably mounted on an electronic typewriter for movement from an open position for viewing by the operator to a closed position for covering the keyboard.

A pivot axis for the character display is located in alignment with a rotatable axis of the platen. This arrangement provides the capability of convenient paper insertion and removal when the character display is located in the open position. This arrangement also provides the capability of having a paper support pivotable between an open position and a closed position when the character display is either in the open or closed position. This arrangement further provides the capability of having a gap between the character display and the paper support for the leading end of the work sheet to pass therethrough and go behind the character display as the trailing end of the work sheet approaches a line-of-write of the typewriter.

If the axis for the character display was located substantially forward of the platen axis, insertion and removal of a work sheet would be difficult. If the pivot axis for the character display was located substantially rearward of the platen axis, then the character display in the open position would be undesirably too high for convenient viewing and undesirably too massive for typewriter stability.

However, the axis for the character display could be slightly offset from the platen axis and preferably parallel to the platen axis and still substantially maintain the same advantages provided by being in alignment with the platen axis.

Pivotably mounting the character display on an electronic typewriter according to the present invention also provides: an aesthetically integrated design with the typewriter; a low profile typewriter; a minimum width typewriter; and a satisfactory height for conveniently viewing data on the LCD panel and convenient viewing of printed text on a work sheet when the character display is in the open position.

The structure for pivotably mounting the character display includes a spring operable to dampen the pivotable movement near the closed position. The dampening is accomplished by adding torsional tension to the spring. During the closing pivotable movement of the character display, tension is added to the spring by a first free end of the spring engaging a first fixed spring stop while the spring continues to rotate with the character display. Dampening the pivotable movement near the closed position prevents the character display from being harshly closed which avoids damaging the character display and/or the typewriter. Adding tension to the spring when moving the character display to the closed position also assists the operator to lift the character display from the closed position to the open position since the added tension biases the display in the opening direction.

The structure for pivotably mounting the character display also includes a brake pad. The brake pad is assisted by the dampening spring for holding the character display in varying adjusted positions near the open position selected by the operator. Adjusting the position of the character display maximizes the readability of the data entered on the LCD panel due to different lighting reflections and different light intensities. The dampening spring assists the brake pad by the structure being operable to add torsional tension to the spring. Tension is added by a second free end of the spring engaging a second fixed abutment near the open position while the spring continues to rotate with the character display.

The paper support is pivotably mounted on the typewriter between an open position for printing purposes and a closed position for covering a platen and an adjacent open area. The adjacent open area is for insertion and removal of a work sheet for printing purposes. The combination of the character display covering the keyboard and the paper support covering the platen and the adjacent open area when in the closed positions provides a cover for the typewriter and conforms to the aesthetically integrated typewriter design.

DESCRIPTION OF THE PREFERRED EMBODIMENT

Figure 1:
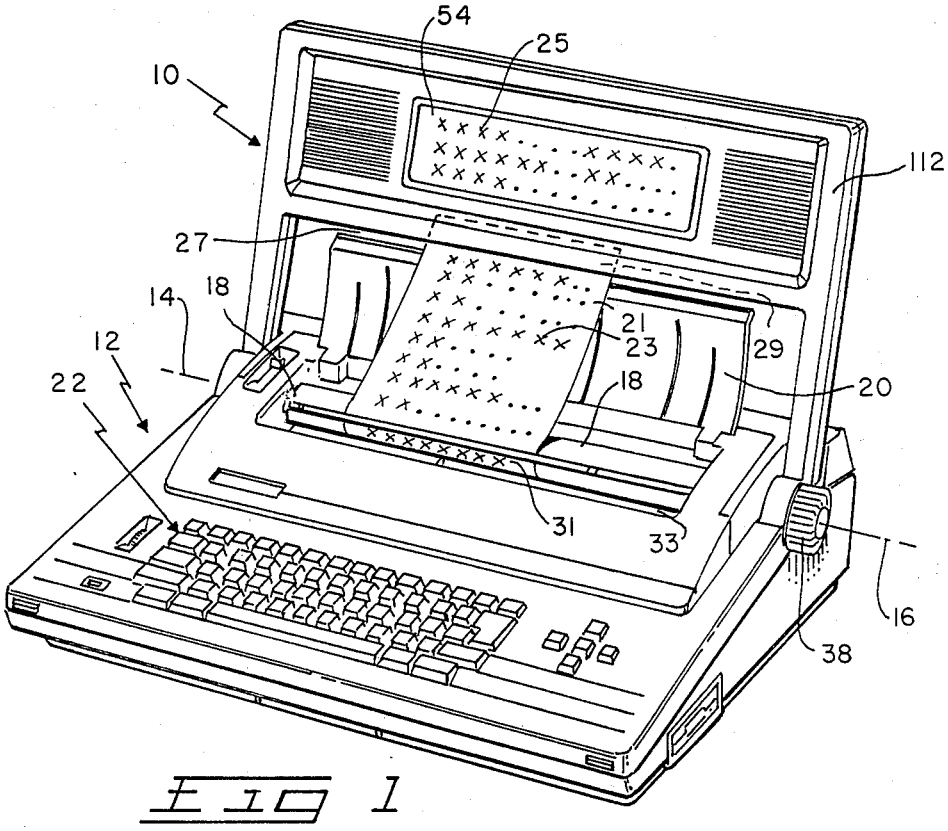
FIG. 1 is a perspective view of an electronic typewriter made in accordance with the present invention showing the character display in an open position.
Figure 2:
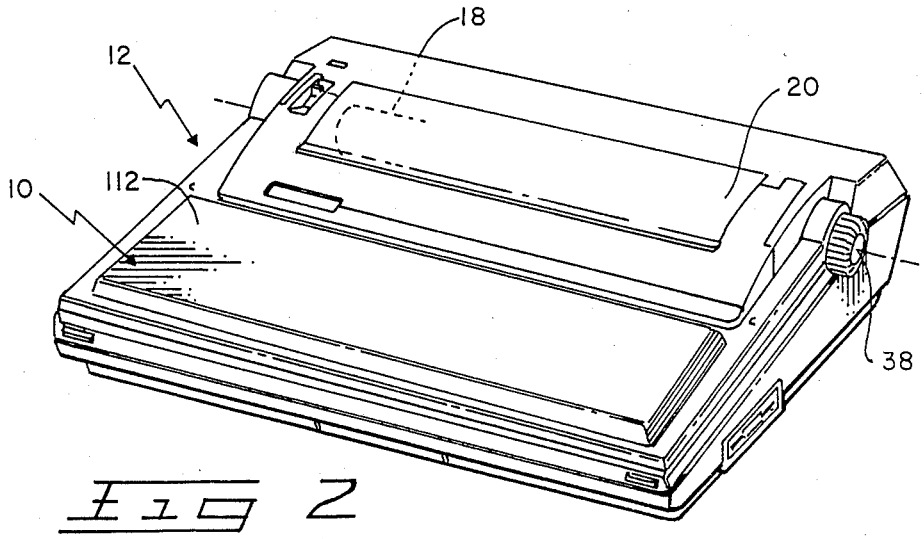
FIG. 2 is a view similar to FIG. 1 showing the character display in a closed position.

Referring to FIGS. 1 and 2, a character display 10 is pivotably mounted on an electronic typewriter 12. A pivot axis 14 for the display 10 is in alignment with a rotatable axis 16 for a platen 18. The display 10 is shown in the open position in FIG. 1. A paper support 20 is also shown in an open position in FIG. 1.

With the display 10 pivotable about the platen axis 16 and located in the open position, a work sheet 21 may be conveniently inserted around the platen 18 for printing purposes and may be conveniently removed from the typewriter 12. Also with the display 10 pivotable about the platen axis 16 and located in the open position, printed text 23 on the work sheet 21 due to operating the keyboard 22 is conveniently viewed and data 25 entered on the display 10 by operating the keyboard 22 at a satisfactory height for convenient viewing. With the display 10 pivotable about the platen axis 16 and located in the open position and with the paper support 20 located in the open position, a gap 27 is provided between the display 10 and the paper support 20 to pass a leading end 29 of the work sheet 21 to allow the leading end 29 to go behind the display 10 when a trailing end 31 of the work sheet 21 approaches a line-of-write of the typewriter 12.

The display 10 and the paper support 20 are shown in the closed position in FIG. 2. In the closed position the display 10 covers a keyboard 22. In the closed position the paper support 20 covers the platen 18 and an adjacent open area 33. The adjacent open area 33 is for insertion and removal of the work sheet 21 for printing purposes. The combination of the display 10 and the paper support 20 in the closed positions provide a cover for the typewriter 12 and conforms to the aesthetically integrated typewriter design.

Figure 3:
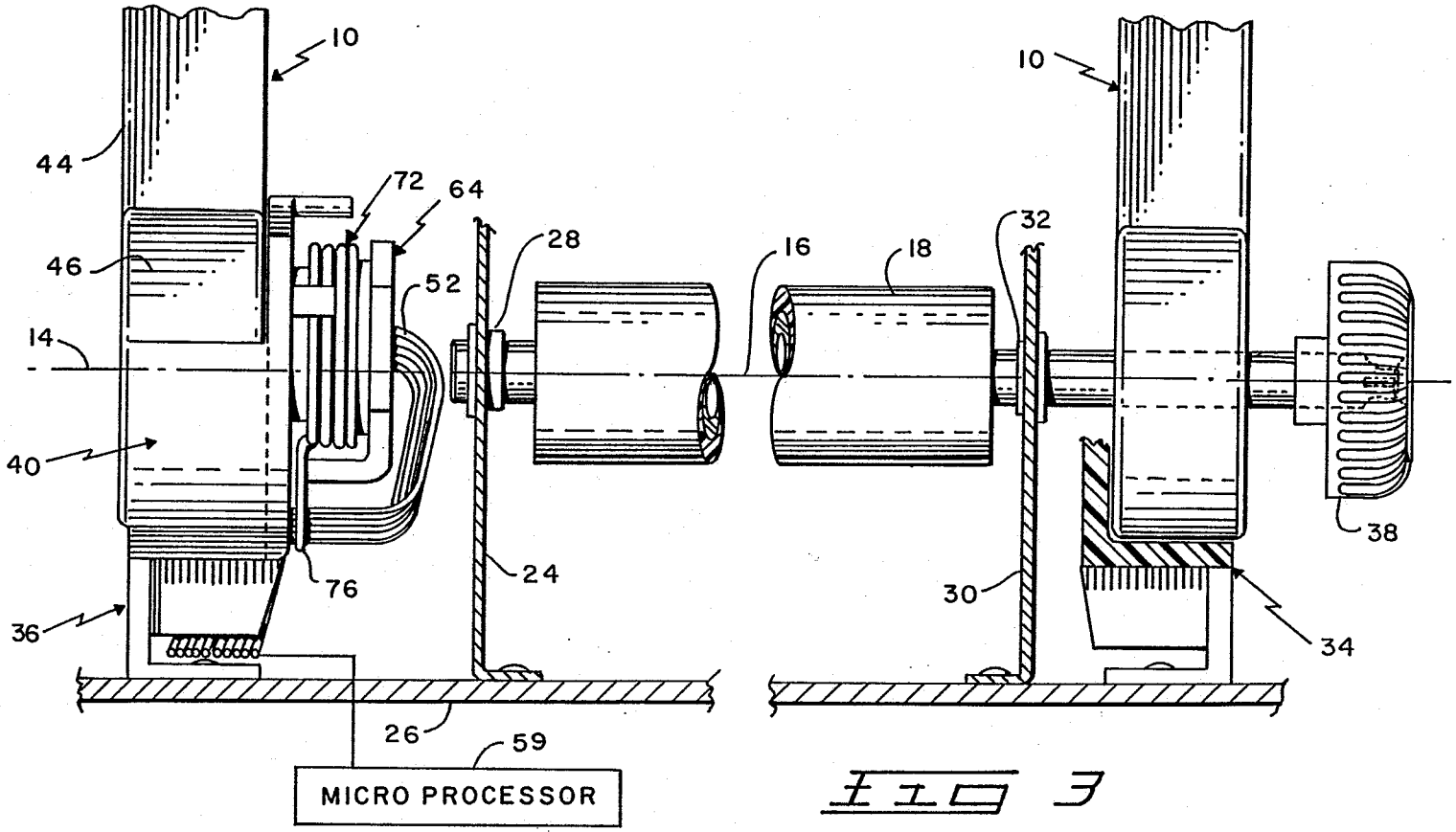
FIG. 3 is a front elevational view showing a support structure for the character display being independent of a support bracket for a platen and showing a pivot axis of the character display being in alignment with a rotatable axis of the platen.

Referring to FIG. 3, the platen 18 and the display 10 are independently pivotable relative to each other even though they have the same pivot axis 14, 16. A bracket 24 is rigidly mounted on a base member 26 for supporting the left end of the platen 18 with a bearing 28 therebetween. Another bracket 30 is rigidly mounted on the base member 26 for supporting the right end of the platen 18 with a bearing 32 therebetween. A support structure 34 is rigidly mounted on the base member 26 for supporting the right side of the display 10. Another support structure 36 is rigidly mounted on the base member 26 for supporting the left side of the display 10.

The support structure 34 and 36 could locate the pivot axis 14 for the display 10 slightly offset from and preferably parallel to the platen axis 16 while still substantially maintaining the previously described advantages provided by having the pivot axis 14 in alignment with the platen axis.

The platen 18, by way of a platen knob 38, can be pivoted relative to the brackets 24 and 30 independent of the support structures 34 and 36. Likewise, the display 10 can be pivoted relative to the support structures 34 and 36 independent of the brackets 24 and 30.

Figure 4:
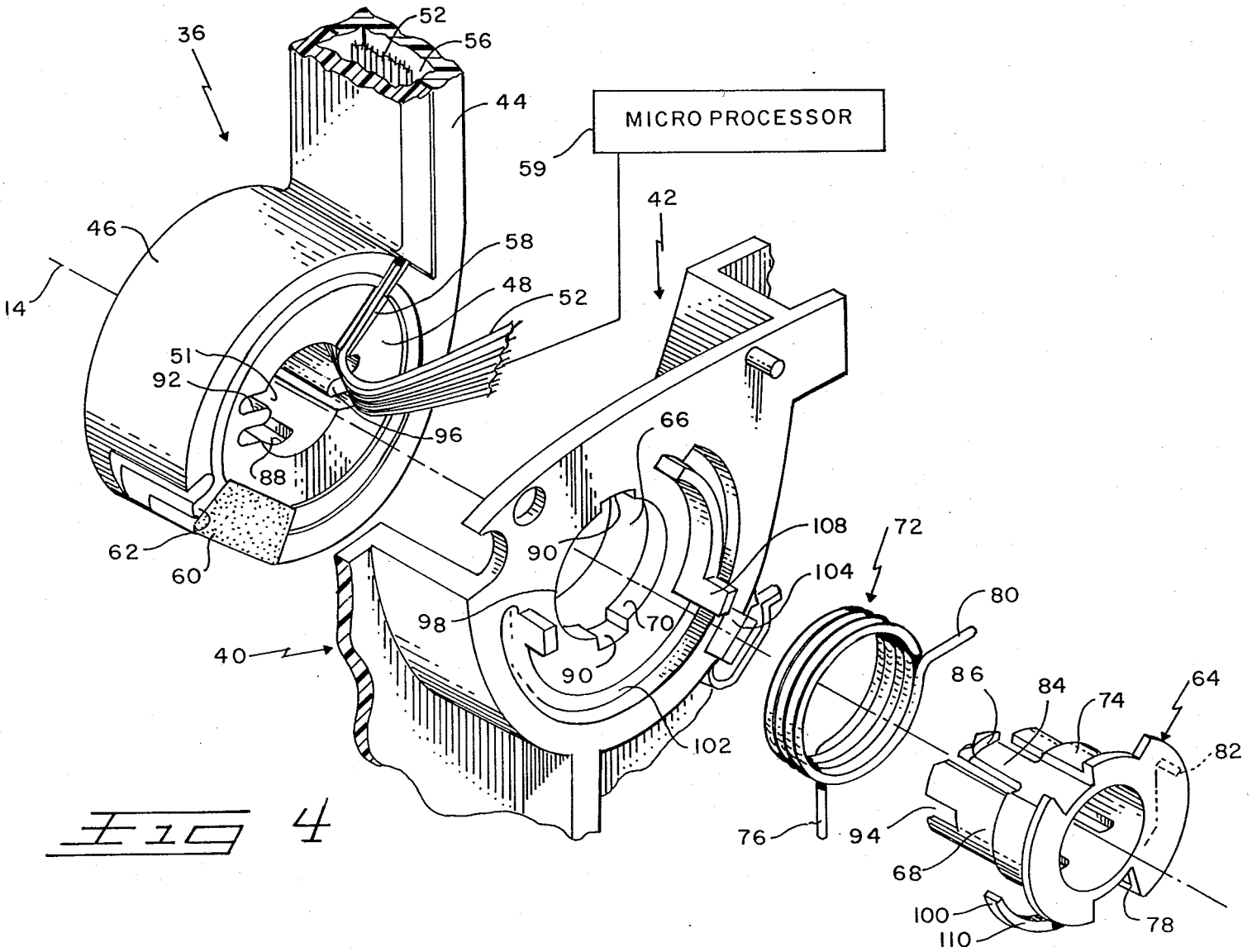
FIG. 4 is an exploded perspective view of a left side support structure for the character display.

Referring now to FIG. 4, a perspective exploded view of the support structure 36 is shown with the display 10 in an open position. A support housing 40, having a circular opening 42 formed therein, is rigidly attached to the base member 26. A left arm 44 of the display 10 has an integral ring-shaped free end 46. The free end 46 seats in the opening 42 for pivotable movement relative to the support housing 40. A collar 48 is integrally formed with the free end 46. The collar 48 has a cylindrical opening 51 at the center thereof. A conductive wire cable 52 extends from an LCD panel 54 (FIG. 1) of the display 10, through a channel 56 in the left arm 44 and through a slot 58 in the collar 48 for connecting the LCD panel 54 to microprocessor 59 in the typewriter. A friction brake pad 60 is seated in a notch 62 in the collar 48 for movement with the collar 48 and the free end 46.

A bearing 64 extends into a circular opening 66 in the support housing 40. A bearing surface 68 on the bearing 64 is pivotably supported by a bearing surface 70 on the support housing 40. A torsion spring 72 is mounted on a shoulder 74 of the bearing 64. A first free end 76 of the spring 72 is biased against an a first moving abutment 78 on the bearing 64. A second free end 80 of the spring 72 is biased against a second moving abutment 82 on the bearing 64. The spring 72 is mounted on the bearing 64 in this manner before inserting the bearing 64 into the opening 66 in the housing 40. Two flexible fingers 84 (only one shown) are integrally formed from the bearing 64 and substantially parallel with the pivot axis 14 of the display 10. A lock abutment 86 is formed on the free end of the finger 84. A corresponding lock abutment 88 is formed on the collar 48. The bearing 64 carrying the spring 72 is inserted into the opening 66 of the support housing 40 by the lock abutments 86 on the finger 84 (only one shown) passing through notches 90 formed in the support housing 40 and into the opening 51 in the collar 48 for engagement with the corresponding lock abutment 88.

Figure 5:
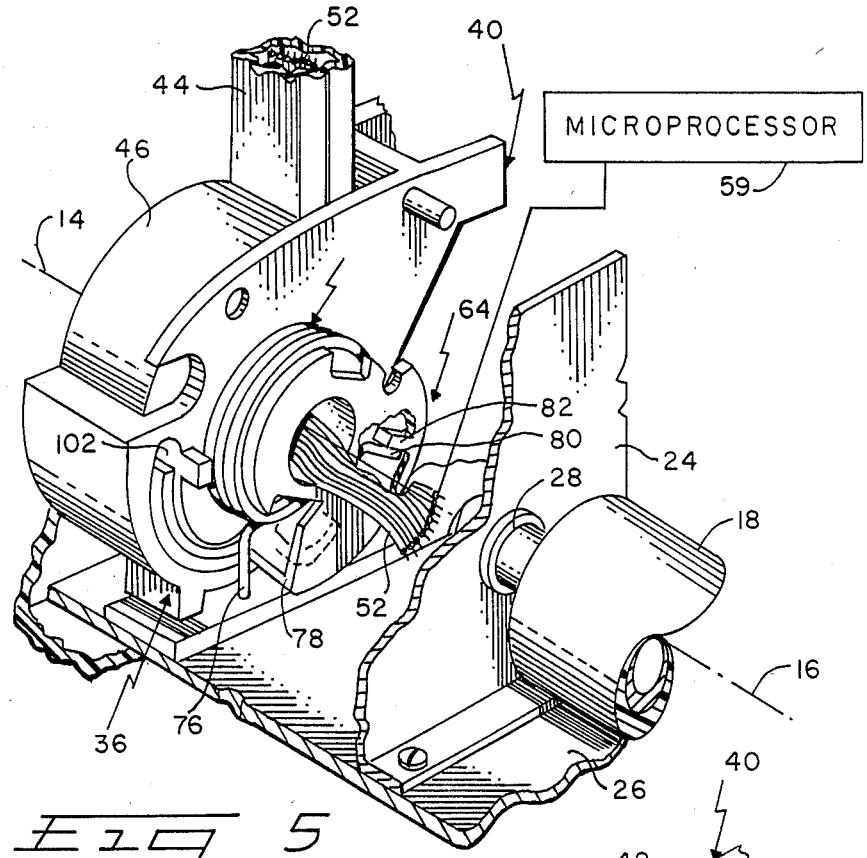
FIG. 5 is an assembled perspective view of the left side support structure with the character display in an open position.
Figure 6:
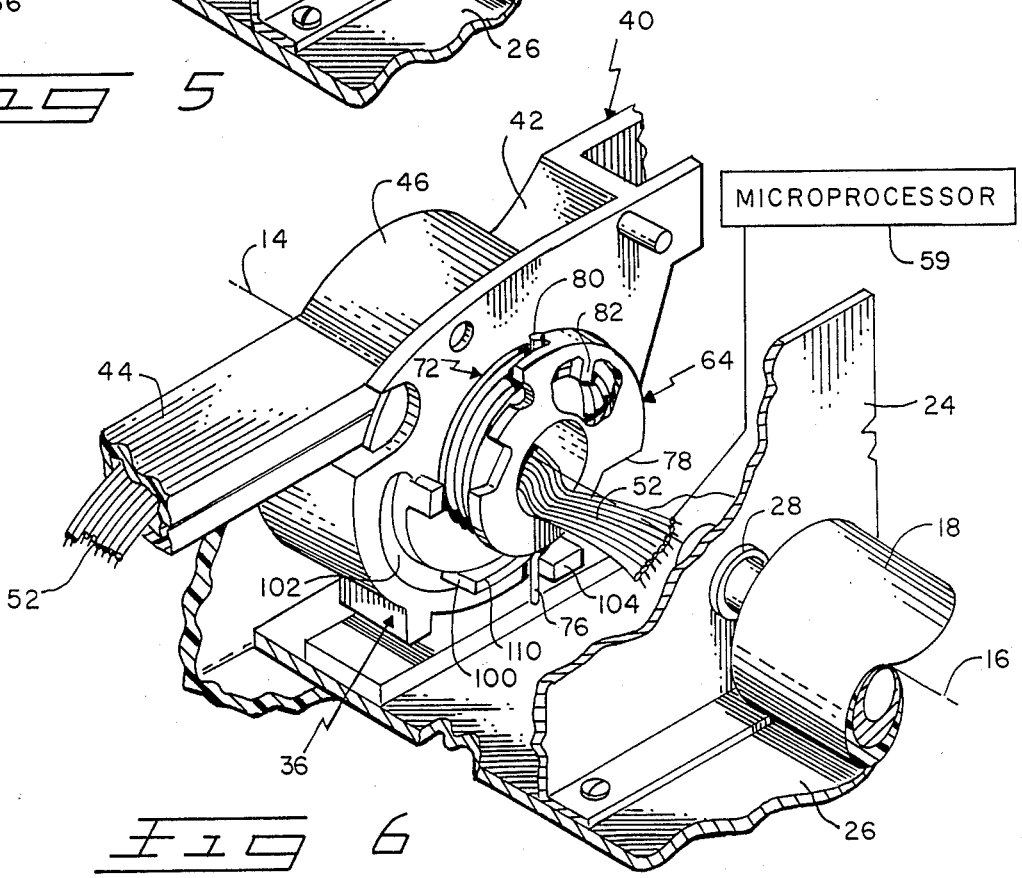
FIG. 6 is a view similar to FIG. 5 showing the character display in a closed position.

A key 92 integrally formed from the collar 48 extends into the opening 51 and enters a keyway 94 in the bearing 64 when inserting the bearing 64 into the opening 51. A second key 96 in the collar 48 enters a second keyway (not shown) in the bearing 64. The keys 92 and 96 and the keyways 94 securely couples the bearing 64 with the collar 48 for pivotable movement therewith. The bearing 64 is inserted until the shoulder 74 abuts against the periphery 98 of the opening 66. The lock abutment 86 will then snap against the lock abutment 88 in the collar 48. This assembled arrangement (FIGS. 5 and 6) locks the free end 46 of the left arm 44 in the opening 42 and locks the bearing 64 to the collar 48. An arcuate extension 100 is integrally formed from th bearing 64 and seats in an arcuate slot 102 in the housing 40 when the bearing 64 is assembled to the collar 48. The extension 100 holds the brake pad 60 in the notch 62. The bearing 64 and the free end 46 pivot together about the pivot axis 14 relative to the support housing 40.

When the display 10 is moved from the open position (FIGS. 1 and 5) to the closed position (FIGS. 2 and 6) by the operator, the bearing 64 is pivoted counter clockwise relative to the housing 40. The first free end 76 of the spring 72 moves with the first moving abutment 78 during a portion (approximately one-half) of the movement of the display 10. The first free end 76 then abuts against a first fixed spring stop 104 integrally formed from the housing 40. Continual movement of the display 10 and the spring 72 to the closed position causes the second free end 80 of the spring 72 to add torsional tension to the spring 72. One advantage of adding torsional tension is to dampen the movement of the display 10 as the display 10 moves to the closed position. Dampening the movement is highly desirable since the display 10 is relatively heavy and is spaced away from the pivot axis 14. Without dampening the closing movement, the display 10 would strike the keyboard 22 rather harshly if closed accidentally, which could damage the display 10 and/or the typewriter 12. Another advantage of adding torsional tension to the spring 72 is the spring 72 assists the operator in lifting the display 10 from the closed position to the open position.

During the continual movement of the display 10 to the closed position and when the first free end 76 of the spring 72 abuts against the first fixed spring stop 104, the first free end 76 provides an axial biasing force against a surface 110 of the extension 100 as the extension 100 moves relative to the first free end 76. In this manner the first free end 76 assists the extension 100 in holding the brake pad 60 in the notch 62. The assistance by the first free end 76 is desirable since the hold force of the extension 100 decreases near its free end.

The LCD panel 54 is a relatively flat panel and is mounted on a cover member 112 forming a relatively flat structure for covering the keyboard 22 when the display 10 is in the closed position.

When the display 10 is moved clockwise from the closed position (FIGS. 2 and 6) to the open position (FIGS. 1 and 5), the bearing 64 will pivot clockwise relative to the housing 40. During a first portion (approximately one-half) of the clockwise movement of the bearing 64, the torsional tension added during moving the display 10 to the closed position is removed. Since the torsional tension added to the spring 72 biases the display in the opening direction, the spring 72 assists the operator during this first portion of the clockwise movement. During a second portion of the clockwise movement of the display 10, the first moving abutment 78 of the bearing 64 will engage the first free end 76 of the spring 72 causing the entire spring 72 to pivot with the bearing 64. When the entire spring 72 pivots with the bearing 64, the spring 72 has no biasing effect on the movement of the display 10.

Figure 7:
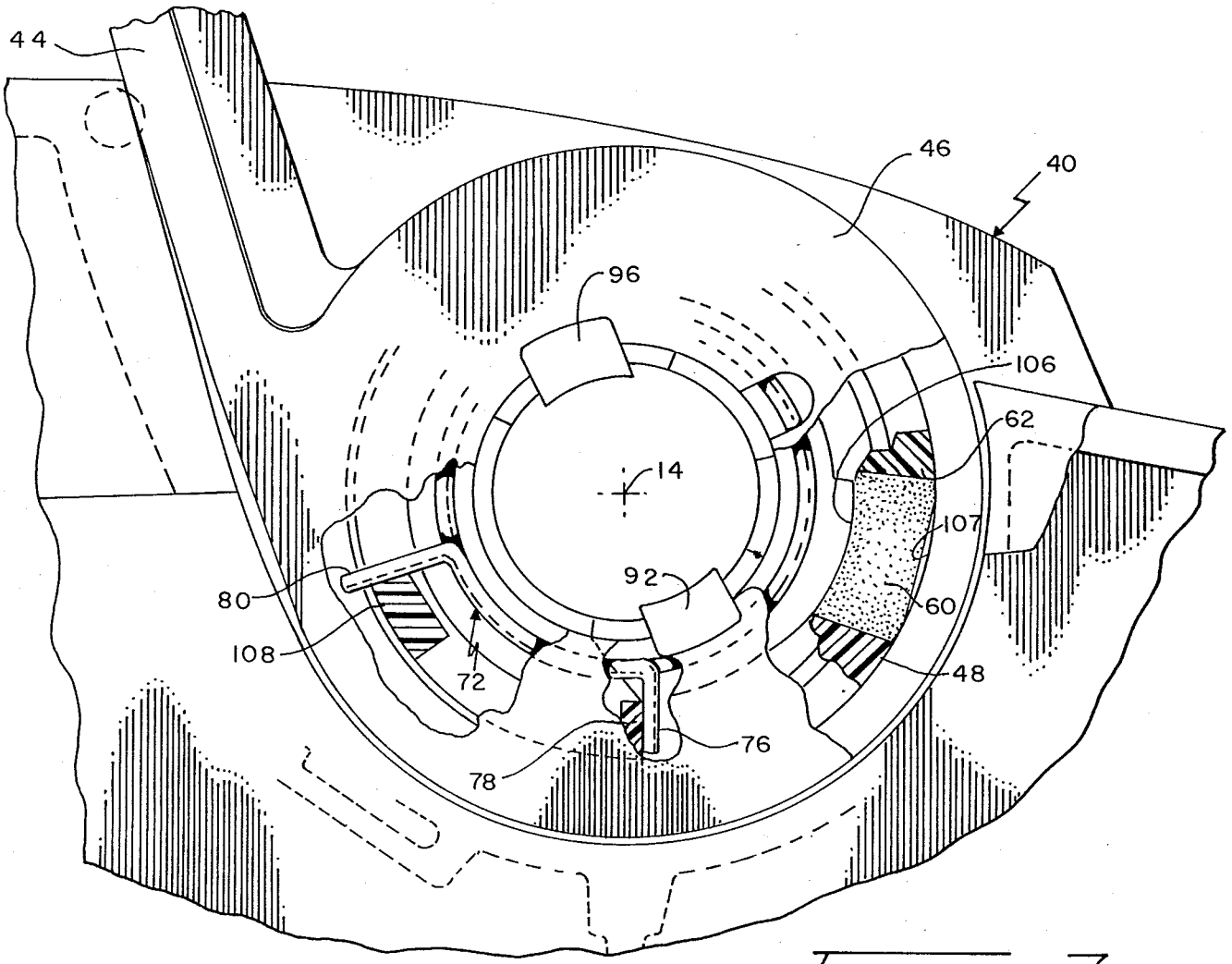
FIG. 7 is an enlarged left end elevational view partially cut-away to show a brake pad and the dampening spring for holding the character display in an adjusted open position.

During a remaining portion of the clockwise movement of the display 10, the brake pad 60 moves against a cam surface 106 integrally formed from an inner wall of the housing 40 (FIG. 7). The brake pad 60 becomes wedged between the cam surface 106 and an inner wall 107 of the housing 40 for braking the pivotable movement of the display 10. Also during the remaining portion of the clockwise movement of the display 10, the second free end 80 of the spring 72 abuts against a second fixed spring stop 108 integrally formed from the housing 40.

Continual movement of the display 10 near the open position causes the first moving abutment 78 of bearing 64 to move the first free end 76 of the spring 72 while the second free end 80 is stopped by the second fixed spring stop 108 instead of moving with the second moving abutment 82 for adding torsional tension to the spring 72. The purpose for adding this torsional tension is to assist the brake pad 60 to hold the display 10 at different positions selected by the operator.

Having this brake system for holding the display 10 in different positions near the open position allows the operator to locate the LCD panel 54 to maximize the readability of the data entered on the LCD panel 54. The readability of the data varies due to different lighting reflections and different light intensities available in offices.

In summary, it can now be seen that the character display 10 having a cover member 112 and a relatively flat LCD panel 54 forming a relatively flat structure and pivoting about the pivot axis 14 which is in alignment with the rotatable axis 16 of the platen 18 provides: convenient paper insertion and removal when the display 10 is located in the open position; the capability of having the paper support 20 pivotable between an open position and a closed position when the display 10 is either in the open or closed position; the gap 27 between the display 10 and the paper support 20 for the leading end of the work sheet to pass therethrough and go behind the display 10; and aesthetic integrated design with the typewriter; a low profile typewriter (FIG. 2); a minimum width typewriter; a satisfactory height for viewing data 25 on the LCD panel 54 and convenient viewing printed text 23 when the display 10 is located in the open position; and a cover for the typewriter when the display 10 located in the closed position covers the keyboard 22 and when the paper support 20 located in the closed position covers the platen 18 and the adjacent open area 33 (FIG.) 2.

What is claimed is:

1. An electronic typewriter having a keyboard, a pivotable character display, and a platen for supporting a work sheet for printing purposes having a rotatable axis comprising:

support structure mounted on the typewriter for supporting the character display for pivotable movement between an open position for viewing the character display and a closed position;

the character display includes a cover member for covering the keyboard when the character display is located in the closed position;

the support structure having a central opening and having a pivot axis for the character display;

the platen axis having one end extending through the central opening for locating the character display axis in alignment with the platen axis;

the support structure includes dampening means, the dampening means includes a spring having a free end; and the support structure includes a moving abutment for moving the free end of the spring therewith during a first portion of the pivotable movement of the character display in a closing direction, and the support structure further includes a fixed abutment for blocking further movement of the free end of the spring during a second portion of the pivotable movement of the character display in the closing direction for adding tension to the spring for dampening the pivotable movement of the character display only near the closed position.

2. An electronic typewriter having a keyboard and a pivotable character display comprising:

support structure mounted on the typewriter for supporting the character display for pivotable movement alternately between an open position for viewing the character display and a closed position for covering the keyboard;

the support structure includes dampening means, the dampening means includes a spring having a free end; and the support structure includes a moving abutment for moving the free end of the spring therewith during a first portion of the pivotable movement of the character display in a closing direction, and the support structure further includes a fixed abutment for blocking further movement of the free end of the spring during a second portion of the pivotable movement of the character display in the closing direction for adding tension to the spring for dampening the pivotable movement of the character display only near the closed position.

3. An electronic typewriter comprising:

a character display mounted on the typewriter for pivotable movement between a closed position and an open position for viewing the character display; and holding means mounted on the typewriter for holding the character display in manually selected positions only near the open position, the holding means includes a brake pad, an inner wall and a cam surface for wedging the brake pad between the inner wall and the cam surface.

4. The electronic typewriter as defined in claim 3 wherein the holding means includes a spring having a free end operable to assist the brake pad to hold the character display in the manually selected positions.

5. The electronic typewriter as defined in claim 4 wherein the holding means includes a moving abutment for moving the free end of the spring therewith during a first portion of the pivotable movement of the character display in an opening direction, and the holding means further includes a fixed abutment for blocking further movement of the free end of the spring during a second portion of the pivotable movement of the character display in the opening direction for adding tension to the spring to assist the brake pad to hold the character display in the manually selected positions only near the open position.

6. The electronic typewriter as defined in claim 3 further comprising a microprocessor and a conductive wire cable; the character display includes a liquid crystal display panel, an arm extending from the liquid crystal display panel to the typewriter, the arm having an enclosed channel, a free end on the arm having an opening; and the conductive wire cable connected to the liquid crystal display panel and extending through the enclosed channel and through the opening for connection to the microprocessor.

* * * * *